United States Patent [19]

Friedel et al.

[11] Patent Number: 4,487,587

[45] Date of Patent: Dec. 11, 1984

[54] SKEG MOUNTED VANE STEERING SYSTEM FOR MARINE DRIVES

[75] Inventors: David G. Friedel; John J. Litjens, both of Oshkosh, Wis.

[73] Assignee: Brunswick Corporation, Skokie, Ill.

[21] Appl. No.: 451,609

[22] Filed: Dec. 20, 1982

[51] Int. Cl.[3] ..... B63H 21/26

[52] U.S. Cl. ..... 440/51; 440/53; 440/63

[58] Field of Search ..... 440/51-53, 440/75-78, 62, 63, 900, 89, 66, 65; 114/162, 144 R; 74/519, 63, 69; 403/26, 346, 347; 464/112, 905

[56] References Cited

U.S. PATENT DOCUMENTS

| | | | |
|---|---|---|---|
| 1,131,862 | 3/1915 | Perkins | 440/51 |
| 2,583,059 | 1/1952 | Neville | 440/51 |
| 3,088,296 | 5/1963 | Barker et al. | 440/78 |
| 3,183,880 | 5/1965 | Shimanckas | 440/52 |
| 3,245,374 | 4/1966 | Urbassik | 440/63 |
| 3,961,595 | 6/1976 | Meyer | 440/89 |
| 4,276,036 | 6/1981 | Nishida et al. | 440/89 |
| 4,318,701 | 3/1982 | Kirkwood et al. | 440/51 |

FOREIGN PATENT DOCUMENTS

| | | | |
|---|---|---|---|
| 531549 | 1/1922 | France | 74/69 |

*Primary Examiner*—Trygve M. Blix
*Assistant Examiner*—Edwin L. Swinehart
*Attorney, Agent, or Firm*—Andrus, Sceales, Starke & Sawall

[57] ABSTRACT

An improved vane steering system for marine drives has the steering vane mounted in the skeg of the propulsion unit. With such a mounting location, the steering vane is submerged in the water in all driving positions of the propulsion unit.

11 Claims, 5 Drawing Figures

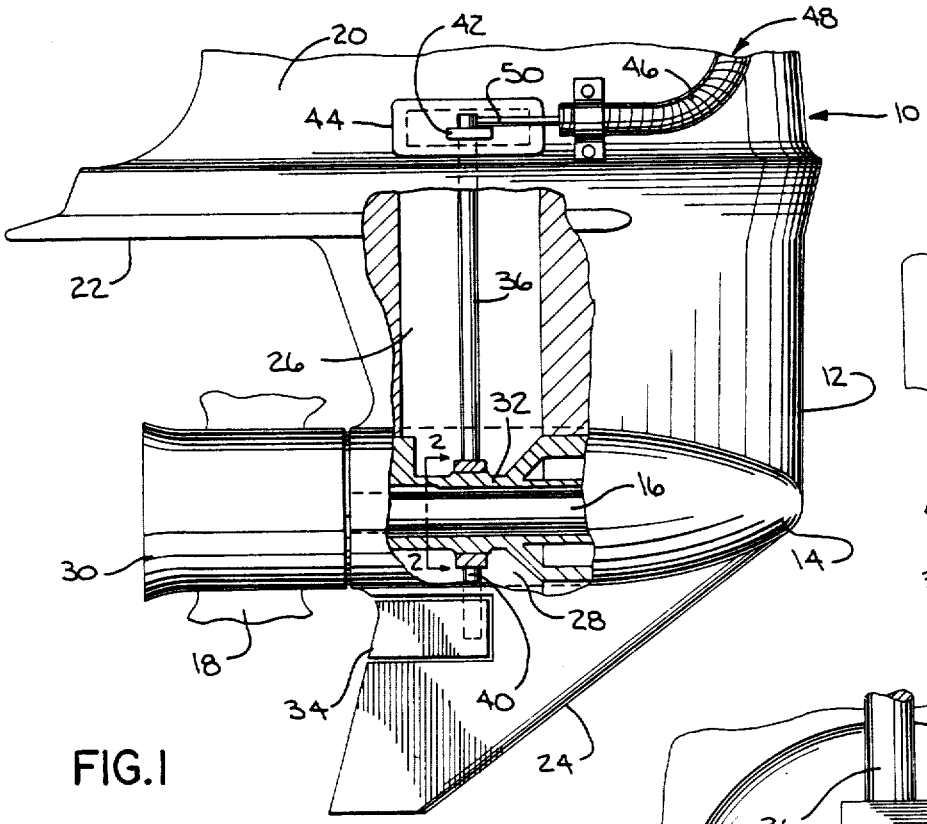
FIG.1
FIG.5
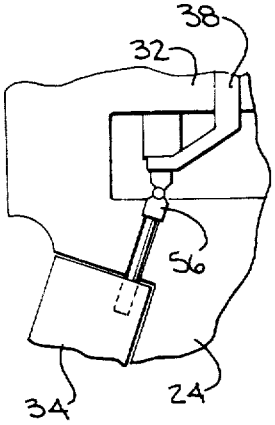
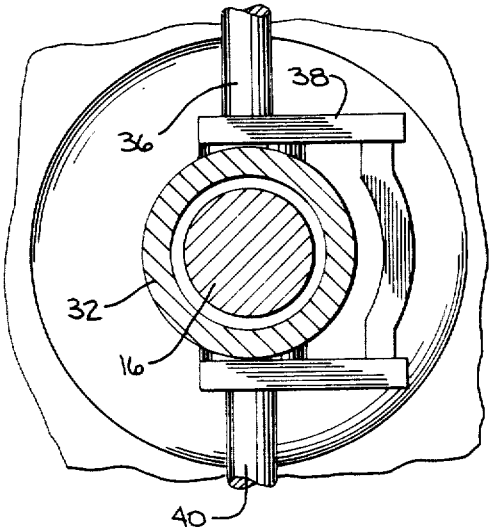
FIG.2
FIG.3
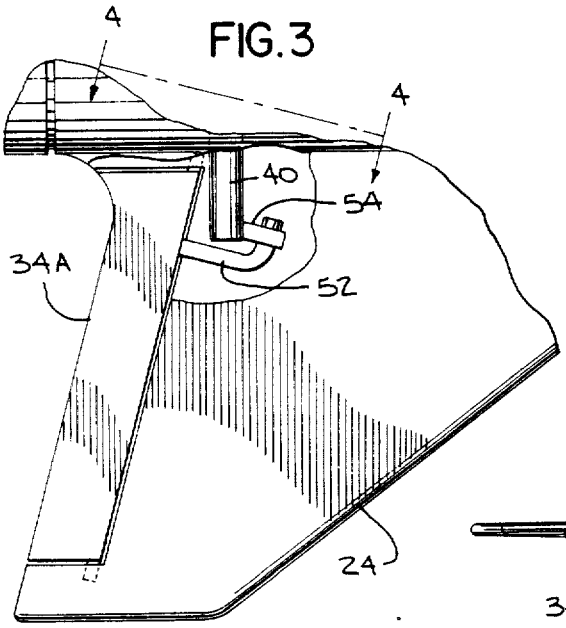
FIG.4
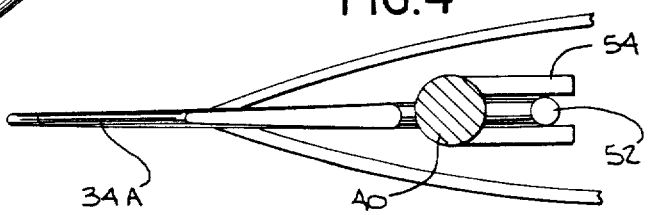

SKEG MOUNTED VANE STEERING SYSTEM FOR MARINE DRIVES

The present invention relates to marine drives and more particularly concerns a movable vane for steering.

It is known to steer or assist in steering a marine drive, such as an inboard-outboard stern drive, or an outboard engine, by means of a rotatable vane mounted on the propulsion unit. The hydrodynamic forces generated upon rotating the vane turn or assist in turning the marine drive, reducing steering loads in the steering system for the boat. The vane also counteracts the effects of propeller torque.

At present, the steering vane is mounted on the underside of the anti-cavitation plate, above and aft of the propeller. This positions the vane in the slip stream of the propeller to obtain the hydrodynamic steering forces. One or more cables connected to the steering apparatus for the marine drive are used to rotate the vane.

However, the propulsion unit is often raised on the transom of the boat to reduce drag, as in high speed watercraft. The steering vane may be partially or completely lifted out of the water, reducing its steering effect or totally preventing its operation. The same phenomena may occur when the propulsion unit is tilted on the transom of the boat.

It is, therefore, the object of the present invention to provide an improved vane steering system for marine drives in which the steering vane is mounted in the skeg of the propulsion unit. With such a mounting location, the steering vane is submerged in the water in all driving positions of the propulsion unit.

FIG. 1 is a partially cut-away side view of the lower portions of a marine drive of the outboard type;

FIG. 2 is a partial view taken along the line 2—2 of FIG. 1 showing a yoke element employed in the vane steering system of the present invention;

FIG. 3 is a view similar to FIG. 1 showing a modified vane configuration;

FIG. 4 is a partial view taken along the line 4—4 of FIG. 3; and

FIG. 5 is a partial view similar to FIG. 3 showing another modification of the invention.

In the following, the marine drive is described as an outboard motor 10 suitable for being pivotally mounted on the transom of a boat. The lower portion of outboard motor 10 has propulsion unit 12 including gear case 14. Gear case 14 contains gears connecting the engine drive shaft to shaft 16 for propeller 18. Streamlined extension 20 of propulsion unit 12 terminates in anti-cavitation plate 22, on the end of which, the steering vane has been heretofore mounted. Propulsion unit 12 also includes skeg 24.

The lower portion of outboard motor 10 contains exhaust passage 26 opening into chamber 28 in propulsion unit 12 for discharging the exhaust gases of the power head of outboard motor 10 through hub 30 of propeller 18. Sleeve 32 surrounds propeller shaft 16 to separate it from the exhaust gases.

In accordance with the present invention, steering vane 34 is mounted in skeg 24 for rotation with respect to the skeg. To provide such rotation, shaft 36 extends down exhaust passage 26. U-shaped yoke 38, shown in FIG. 2, surrounds sleeve 32 on one side. Shaft 40 extends to steering vane 34 and is fastened to it. The ends of shafts 36 and 40 may be journalled in sleeve 32 if necessary or desired. The upper end of shaft 36 is journalled in an appropriate bearing in exhaust passage 26. Yoke 38 may contain an additional U-shaped member diametrically opposite the one shown in FIG. 2 so as to surround sleeve 32 on both sides.

The upper end of shaft 36 contains lever arm 42 passing through flexible seal 44 to the exterior of one side of the lower portion of outboard motor 10. The casing 46 of flexible cable 48 is fastened to the lower portion of the outboard motor. Core 50 of cable 48 is fastened to lever arm 42 for rotating shafts 36 and 40 and steering vane 34. The other end of cable 48 is connected to a vane steering control in the steering apparatus for the boat. The steering control shown in U.S. Pat. No. 4,349,341 assigned to the same assignee as the present application and modified for single cable operation, may comprise such a steering control. Or, lever arms may extend from shaft 36 out both sides of the lower portion of outboard motor 10, in which case the steering control shown in the aforesaid patent may be used without modification.

In operation, to steer the marine drive, steering vane 34 is turned in the same direction as it is desired to turn the boat and opposite to the necessary turning of outboard motor 10. For example, to steer the boat to the left or to port; that is, to swing the bow in the counterclockwise direction, core 50 of cable 48 is extended to rotate steering vane 34 in a counterclockwise direction, when viewed from above. The counterclockwise rotation of steering vane 34 generates a hydrodynamic force on outboard motor 10 that assists in rotating the motor in the clockwise direction. This steers the boat in the counterclockwise direction.

When outboard motor 10 is driving the boat straight ahead, there are forces and torque acting on the propeller so as to cause a torque on the outboard motor about the steering axis. With the system of the present invention, vane 34 can be rotated so as to largely counterbalance the torque about the steering axis and thus greatly reduce the steering loads in the steering apparatus for the boat.

With steering vane 34 mounted in skeg 24, it is submerged in all driving positions of propulsion unit 12.

FIG. 1 shows a low aspect ratio, slightly counterbalanced steering vane 34 in which a portion of the vane is ahead of the axis of rotation of shaft 40. Other configurations of steering vane 34 may be employed. For example, FIGS. 3 and 4 show a high aspect ratio, non-counterbalanced steering vane 34A. Vane 34A is pivotally mounted at either end of skeg 24. Lever arm 42 extends from steering vane 34A to engage fork 54 on the end of shaft 40 to transfer the rotation of shaft 40 to vane 34A while retaining the proper relationship between the direction of shaft rotation and the direction of vane rotation. Shaft 36 may be moved rearwardly in exhaust passage 26 to facilitate the coupling of shaft 40 to steering vane 34A. Other coupling means, such as gearing or the universal joint 56 shown in FIG. 5, may be employed, if desired.

Various modes of carrying out the invention are contemplated as being within the scope of the following claims particularly pointing out and distinctly claiming the subject matter which is regarded as the invention.

We claim:

1. In a steerable marine drive pivotally mounted on the transom of a boat and having a non-rotatable skeg extending below a drive shaft member for a propeller, an improved steering system comprising:

a steering vane mounted in the non-rotatable skeg and positioned completely below the propeller drive shaft member, said steering vane being rotatable with respect to the marine drive; and means coupled to said vane for rotating same with respect to the marine drive to generate hydrodynamic steering forces on the marine drive.

2. The improved steering system of claim 1 wherein said rotating means comprises a shaft means coupled to said steering vane and journalled in the marine drive.

3. The improved steering system of claim 2 wherein the marine drive has an exhaust passage terminating adjacent the skeg and wherein said shaft means extends through the exhaust passage.

4. The improved steering system of claim 3 wherein said shaft means contains a member transmitting rotary motion around the propeller drive shaft member.

5. The improved steering system of claim 4 wherein said member comprises a yoke member at least partially surrounding the propeller drive shaft member.

6. The improved steering system of claim 3 wherein said shaft means contains a lever arm extending from the exhaust passage for receiving a shaft rotating means.

7. The improved steering system of claim 1 wherein said steering vane is of the low aspect ratio type.

8. The improved steering system of claim 1 wherein said steering vane is of the high aspect ratio type.

9. The improved steering system of claim 1 including coupling means intermediate said steering vane and said vane rotating means.

10. The improved steering system of claim 9 wherein said coupling means comprises a fork on said vane rotating means engaging a lever on said vane.

11. The improved steering system of claim 1 wherein said vane rotating means contains a universal joint.

* * * * *